US005839449A

United States Patent [19]

Banerjee et al.

[11] Patent Number: 5,839,449

[45] Date of Patent: Nov. 24, 1998

[54] LOW CO CIGARETTE

[75] Inventors: Chandra Kumar Banerjee, Pfafftown; Timothy Brian Nestor, Winston-Salem; Jeffery Scott Gentry, Pfafftown; Elbert Curtis Jones, Jr., Sherrill's Ford; Roger Grady Hayworth, High Point; Joanne Naomi Taylor, Germanton, all of N.C.

[73] Assignee: R.J. Reynolds Tobacco Company, Winston-Salem, N.C.

[21] Appl. No.: 593,024

[22] Filed: Jan. 29, 1996

[51] Int. Cl.[6] ..... A24D 3/04

[52] U.S. Cl. ..... 131/342; 131/341

[58] Field of Search ..... 131/341, 344, 131/345, 339, 342

[56] References Cited

U.S. PATENT DOCUMENTS

| | | | |
|---|---|---|---|
| 2,693,193 | 11/1954 | Pelletier . | |
| 3,059,649 | 10/1962 | Bernhard . | |
| 3,283,762 | 11/1966 | Kissel . | |
| 3,486,508 | 12/1969 | Sipos . | |
| 3,714,949 | 2/1973 | King . | |
| 3,791,265 | 2/1974 | Wescott et al. . | |
| 4,022,222 | 5/1977 | Berger . | |
| 4,034,765 | 7/1977 | Hall . | |
| 4,291,712 | 9/1981 | Koster . | |
| 4,357,950 | 11/1982 | Berger . | |
| 4,716,912 | 1/1988 | Leonard . | |
| 4,898,190 | 2/1990 | Deal . | |
| 5,090,426 | 2/1992 | Tang . | |
| 5,105,834 | 4/1992 | Saintsing et al. | 131/341 X |
| 5,360,023 | 11/1994 | Blakley et al. | 131/342 X |
| 5,365,951 | 11/1994 | Arterbery et al. | 131/342 X |

FOREIGN PATENT DOCUMENTS

| | | | |
|---|---|---|---|
| 2091078 | 7/1982 | United Kingdom | 131/339 |

OTHER PUBLICATIONS

Research Disclosure No. 13201, Apr. 1975.

*Primary Examiner*—John G. Weiss

[57] ABSTRACT

A cigarette smoking article achieves very low levels of CO and other gas phase components by means of substantial air dilution, but has an acceptable pressure drop and sufficient delivery of particulate matter to provide a flavorful smoke. The filter has two sections, an upstream section which has substantially no pressure drop thereacross and a downstream section which provides substantially all the pressure drop of the filter. Dilution air is admitted to the upstream section of the filter to mix with mainstream smoke before it passes through the downstream section of the filter and thereby reduce the CO and gas phase levels in the smoke.

7 Claims, 1 Drawing Sheet

LOW CO CIGARETTE

FIELD OF THE INVENTION

The present invention relates to smoking articles, such as cigarettes, and more particularly to a cigarette having a filter configured to reduce gas phase components, especially CO, while achieving satisfactory flavor and pressure drop or draw characteristics.

BACKGROUND OF THE INVENTION

Popular smoking articles, such as cigarettes, have a substantially cylindrical rod shaped structure and include a charge of smokable material such as shredded tobacco (e.g., in cut filler form) surrounded by a paper wrapper, thereby forming a so-called "tobacco rod." Normally, a cigarette has a cylindrical filter element aligned in an end-to-end relationship with the tobacco rod. Typically, the filter element includes cellulose acetate tow circumscribed by plug wrap, and is attached to the tobacco rod using a circumscribing tipping material. It also has become desirable to perforate the tipping material and plug wrap, in order to provide dilution of drawn mainstream smoke with ambient air.

Cigarette mainstream smoke is made up of a gas phase and particulate phase. It is known that the gas phase of mainstream smoke does not significantly contribute to the pleasing taste or flavor of cigarette smoke. It would be desirable, therefore, to reduce gas phase components to as great an extent as possible. One well-known method widely used to reduce the amount of gas phase contained in mainstream smoke is air dilution of the smoke. Air dilution is typically accomplished by providing ventilating passages or holes in a filter attached to the tobacco rod of a cigarette. A disadvantage of air dilution is that it significantly reduces the pressure drop or draw characteristics of the cigarette. Adjustment of the draw characteristics to a desirable level usually adversely affects the flavor or taste of the cigarette because it results in a reduction of the amount of particulate matter in the mainstream smoke which contributes to flavor or taste.

It would be desirable, therefore, to provide a filter element of a smoking article, such as a cigarette, with sufficient air dilution to significantly reduce gas phase compounds, especially CO, in the mainstream smoke, while at the same time maintaining an acceptably high pressure drop. Furthermore, it would be desirable to provide such a cigarette with a filter element that is capable of being manufactured using conventional manufacturing apparatus and methods.

SUMMARY OF THE INVENTION

The present invention is directed to a cigarette smoking article with a filter element that is specially designed and constructed to achieve a high level of air dilution to significantly reduce gas phase components and to provide an acceptably high pressure drop without significant decrease in the particulate matter in the mainstream smoke. The filter element of the invention can be made in either a single unitary form or in a dual segment form or embodiment. In both those embodiments, the filter element comprises a first filter portion provided with air dilution and through which substantially all mainstream smoke passes with zero or substantially zero pressure drop and a second filter portion which is designed to achieve an acceptable pressure drop and relatively low filtration efficiency to maintain an acceptable flavor or taste to the smoker. Air dilution is provided in the first filter portion by one or more rows of circumferential perforations extending through a conventional tipping paper and plug wrap surrounding the filter element. To achieve zero or substantially zero pressure drop, the first section of the filter element comprises an essentially open tube or cavity of relatively large diameter that minimally restricts the passage of smoke therethrough. The second filter portion has a relatively short axial length and is designed to provide maximum pressure drop with relatively low filtration efficiency. In the case of a cellulose acetate tow, a suitable tow is a 5.0/80,000 dpf (2×5.0/40,000 dpf) cellulose acetate tow.

In the single or unitary embodiment of the filter element of the invention, the filter is made of a steam-bonded cellulose acetate tow with a tapered cylindrical cavity open at the tobacco rod end of the filter and a solid cellulose acetate section at the mouth end of the filter. For a filter element having a 8 mm diameter, the cavity is approximately 4 mm in diameter with a 2 mm wall. A typical filter has a length of about 27 mm with a cavity having a depth of about 16–19 mm. The large diameter of the cavity in the filter element diverts substantially all mainstream smoke to the cavity regardless of the density of the cavity walls. The solid portion of the filter element at the mouth end may have a uniform density, but typically has a somewhat lower density in the central region of the solid portion. A lower density in the central region of the solid portion facilitates channeling the particulate matter toward the center of the filter resulting in less deposition of particulate matter on the walls of the cavity, delivery of more particulate matter to the smoker and thus a better tasting, more flavorful cigarette.

Air dilution holes, preferably made by laser-perforation or provided by preperforated tipping paper, are arranged circumferentially in the filter upstream of the solid filter portion in that portion of the filter containing the cavity, e.g., about 13 mm from the mouth end of the filter. Dilution air thus mixes with mainstream smoke in the cavity to reduce the level of gas phase components, including CO, in the smoke. The highly air diluted smoke then passes through the solid portion of the filter at the mouth end of the filter thereby providing the necessary pressure drop yet permitting the passage therethrough of sufficient particulate matter to maintain the desirable flavor characteristics of the mainstream smoke.

In a first embodiment of the dual segment filter, the first or tobacco rod end filter segment comprises a hollow tube made of steam-bonded cellulose acetate, paper, polymeric materials or any other suitable material. The second or mouth end filter segment comprises a solid, relatively short cellulose acetate filter which provides an acceptable pressure drop with relatively low removal of particulate matter. Air dilution holes, also preferably laser-perforated, are circumferentially formed in the first segment about 13 mm from the mouth end of the dual filter.

In one construction of a filter about 27 mm in length, the first hollow tube segment is about 15 mm to about 20 mm in length and the second segment is about 7 mm to about 12 mm in length. As in the unitary filter construction, the hollow tube forms a mixing cavity or chamber where dilution air mixes with the mainstream smoke and passes through the second filter segment to achieve an acceptable pressure drop with minimal loss of particulate matter resulting in a better tasting cigarette with reduced gas phase components, especially CO.

A second embodiment of the dual segment filter includes a first filter segment made of a loosely gathered paper which may include carbon. The gathered paper forms a plurality of relatively large diameter longitudinal channels which produces no or a very low pressure drop of the mainstream smoke. The second or mouth end segment of this embodiment is made of a cellulose acetate filter segment similar to that of the first embodiment of the dual segment filter.

Air dilution holes are provided in the same way as in the first embodiment and in the same location, i.e., in the first filter segment. In a construction of this second embodiment, the first segment is made with a gathered web or paper containing about 17% activated carbon and gathered into a cylindrical form with a length of about 17 mm. The mouth end segment is cellulose acetate tow with a length of about 10 mm. The presence of carbon in the filter provides a taste advantage as disclosed, for example, in U.S. Pat. No. 5,360,023 assigned to the assignee of this invention and also reduces other gas phase components of mainstream smoke.

A dual segment filter according to the invention may also be constructed with a first filter segment comprising a very low density fibrous material, such as cellulose acetate, cellulose, polypropylene or other polymeric or cellulosic fibrous material. The second filter segment may comprise a more dense fibrous material, such as the cellulose acetate filter segment of the first embodiment of the dual segment filter, or any other suitably dense fibrous material, including cellulosic and polymeric fibrous materials.

Important features of the present invention are that a sufficient amount of air dilution is provided in the filter to substantially lower the gas phase components of the mainstream smoke upstream of any substantial pressure drop of the smoke and that substantially all the pressure drop of the filter is provided downstream of air dilution after the mainstream smoke has mixed with the dilution air.

With the foregoing and other advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
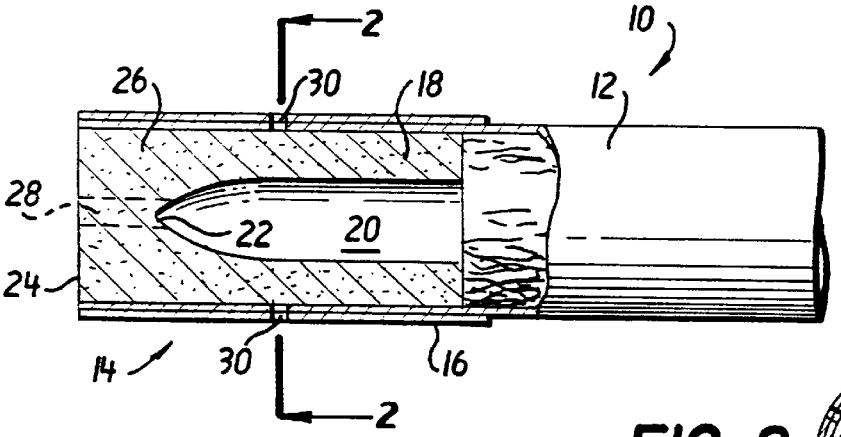
FIG. 1 is a fragmentary longitudinal cross-section of a smoking article made according to the invention.
Figure 2:
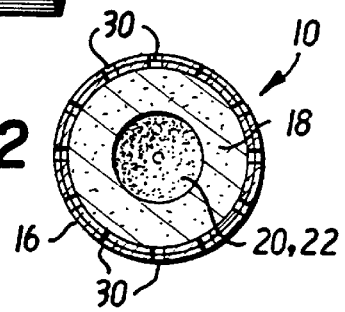
FIG. 2 is a transverse cross-section taken along line 2—2 of FIG. 1.

Referring now to the drawings, a first embodiment of the smoking article of the invention is illustrated in FIGS. 1 and 2 and is designated generally by reference numeral 10. Smoking article 10 is a filtered cigarette comprising a tobacco rod 12 to which is attached a filter element 14 by conventional means, such as tipping paper 16. Filter element 14 is formed as a unitary, single filter segment 18. Filter segment 18 has a cylindrical cavity or chamber 20 formed coaxially therein which is open at the tobacco rod end of the filter and gradually or conically tapers to a closed end or vertex 22 several millimeters upstream from the mouth end 24 of the filter. A solid filter portion 26 is formed between vertex 22 and the mouth end 24 of the filter. In a typical, but non-limiting construction, the filter segment 18 has a length of about 27 mm with a cavity 20 having an axial length of about 16–19 mm, a diameter of about 4 mm and a wall thickness of about 2 mm.

When a filter of this design is constructed using, for example, a reciprocating plunger to form the cavity 20 in a consolidated and condensed cellulose acetate tow, a low density region 28 of about 1 mm in diameter extends from the vertex 22 of cavity 20 to the mouth end 24 of the filter. This lower density region 28 together with the tapered or conical end of the cavity 20 facilitates the channeling of the mainstream smoke to the low density region 28. Because of the relatively large diameter of the cavity 20 there is no significant pressure drop across the filter until the smoke passes into the low density region 28 in the solid filter portion 26. The combination of minimal pressure drop in the cavity and the channeling of the smoke by the tapered wall of the cavity and the low density region 28 results in minimal deposition of particulate matter on the walls of the cavity and delivery of a relatively high level of particulate matter to the smoker thereby providing a more flavorful cigarette.

The filter segment 14 is provided with a plurality of circumferentially spaced laser perforated holes 30 for admitting diluting air into the cavity 20. Preferably, the air dilution holes 30 provide a high air dilution, e.g., on the order of 30% to 65% or more. Typically, such high levels of air dilution in conventional filters results in an unacceptably low pressure drop. According to the present invention, however, all air dilution occurs upstream of the pressure drop substantially all of which pressure drop is built into the solid portion 26 of the filter segment 18.

Cigarettes constructed according to this first embodiment of the invention with a unitary filter element yielded significant reduction in CO level and acceptable particulate matter (tar) and pressure drop values as follows:

EXAMPLE 1

Tobacco rods 57 mm long were constructed using a conventional tobacco blend and 454 cigarette paper from Ecusta, a division of P. H. Glatfelter of Pisgah Forest, N.C. 28768. Control cigarettes were made by attaching a tobacco rod to a conventional cellulose acetate monofilter 27 mm long and air diluted about 25%. Test cigarettes according to the invention were constructed by attaching tobacco rods to filters made of steam-bonded cellulose acetate with a 27 mm length having a 4 mm diameter cavity approximately 19 mm deep, and an 8 mm solid mouth end section. Air dilution of about 60% was provided by laser perforations in the filters of both the control and test cigarettes 13 mm from the mouth end of the filters. The control and test cigarettes were smoked under FTC conditions and yielded the following results:

| Test Parameter | Control | Test |
|---|---|---|
| Filter type | Conventional | Shaped cavity |
| Filter tow | Cellulose acetate | Cellulose acetate |
| Tow description, dpf | 2.7/35,000 | 2 × 5.0/40,000 |
| Cavity size, mm | 0 | 19 |
| Filter length, mm | 27 | 27 |
| Tobacco rod length, mm | 57 | 57 |

-continued

| Test Parameter | Control | Test |
|---|---|---|
| Air dilution, % | 24.6 | 60 |
| Cigarette pressure drop, mm of water | 122 | 100 |
| FTC SMOKE DATA | | |
| Puffs/cigarette | 8.0 | 8.8 |
| WTPM, mg | 13.9 | 10.5 |
| Tar, mg | 11.4 | 8.6 |
| Nicotine, mg | 0.93 | 0.80 |
| CO, mg | 13.3 | 4.9 |
| CO/Tar ratio | 1.17 | 0.57 |

As can be seen from Example 1, the high level of air dilution (60%) resulted in a CO level in the test cigarette of 4.9 mg compared with 13.3 mg CO for the control cigarette. Pressure drop of the control cigarette was 122 mm of water and that of the test cigarette 100 mm of water. Particulate matter levels were 11.4 mg and 8.6 mg respectively for the control and test cigarettes.

Figure 3:
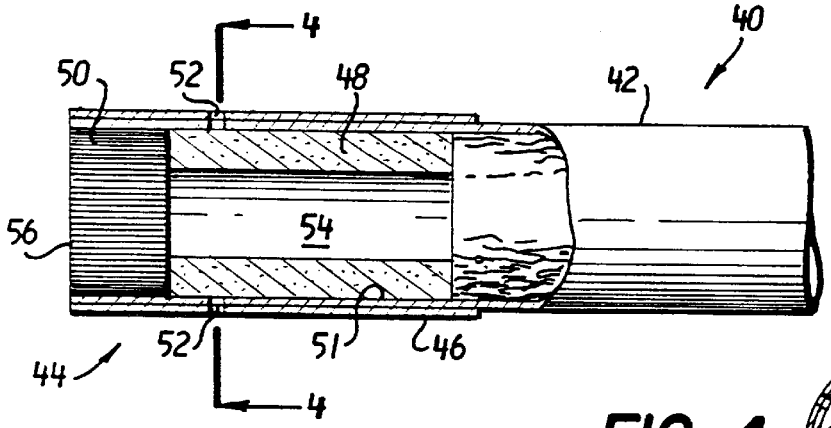
FIG. 3 is a fragmentary longitudinal cross-section of an alternative embodiment of a smoking article made according to the invention.
Figure 4:
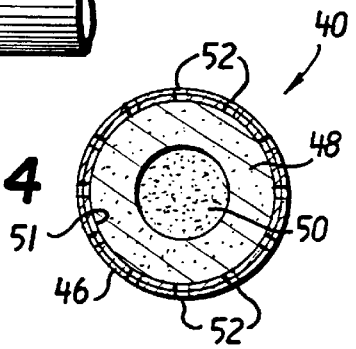
FIG. 4 is a transverse cross-section taken along line 4—4 of FIG. 3.

Referring now to FIGS. 3 and 4, a second embodiment of a smoking article according to the invention is a cigarette designated generally by reference numeral 40. Cigarette 40 comprises a tobacco rod 42 to which is attached a filter element 44 by means of conventional tipping paper 46. In this embodiment, the filter element 44 is formed as a dual filter with first and second filter segments 48, 50 respectively, combined with a conventional plug wrap 51. First filter segment 48 comprises a hollow cylindrical tube made of steam-bonded cellulose acetate, paper or other suitable material. The length of first filter segment 48 is preferably in the range of 15 mm to 20 mm.

The second filter segment 50 is preferably a cellulose acetate tow selected to provide maximum pressure drop per unit length with minimum particulate matter removal. It has been found that a suitable tow is 5.0/80,000 dpf (2×5.0/40,000 dpf) cellulose acetate made by Celanese. The length of segment 50 is preferably in the 7 mm to 12 mm range.

Air dilution holes 52 are circumferentially provided in the first filter segment 48 by means of laser perforation so as to provide substantial air dilution, usually greater than about 30% air dilution, and preferably in the 50%–60% range. The hollow tubular first filter segment 48 may be relatively porous so as to admit a high volume of ventilating air through the laser perforations in the tipping paper 46 and plug wrap 51 into a chamber 54 where the ventilating air mixes with mainstream smoke from the tobacco rod 42 and passes through the second filter segment 50 to the mouth end 56 of the filter 44. It will be appreciated by those skilled in the art that little or no mainstream smoke will pass longitudinally through the filter segment 48 even if it is very permeable because of the large, low pressure flow path through the central chamber 54 of the segment 48.

Cigarettes constructed according to this second embodiment of the invention with a dual segment filter yielded significant reduction in CO and other gas phase components of the smoke, yet delivered sufficient particulate matter at an acceptable pressure drop to provide a flavorful taste to the smoker as described in the following example:

EXAMPLE 2

Tobacco rods 57 mm long were constructed using a conventional tobacco blend and 454 cigarette paper from Ecusta. Control cigarettes were made as described in Example 1. Test cigarettes according to the invention were made with a tobacco rod and a filter comprising a steam-bonded cellulose acetate tube 20 mm in length combined with a 7 mm long mouth end segment made with a 2×5.0/40,000 dpf cellulose acetate tow and air diluted about 55% by laser perforations 13 mm from the mouth end of the filter. The control and test cigarettes were smoked under FTC conditions and yielded the following results:

| Test Parameter | Control | Test |
|---|---|---|
| Filter | Conventional | Dual/Tube |
| Tob. Column Length, mm | 57 | 57 |
| Filter Length, mm | 27 | 27 |
| Filter segment length, mm | — | 20 + 7 |
| Air Dilution, % | 21.5 | 54.1 |
| Cigarette pressure drop, mm of water | 127 | 105 |
| FTC SMOKE DATA | | |
| Puffs/cigt. | 7.9 | 7.9 |
| WTPM, mg | 11.8 | 11.7 |
| Tar, mg | 9.9 | 9.3 |
| Nicotine, mg | 0.75 | 0.85 |
| CO, mg | 11.4 | 6.0 |
| CO/TAR Ratio | 1.15 | 0.65 |
| MS CARBONYLS | | |
| Formaldehyde, μg | 9.8 | 9.8 |
| Acetaldehyde, μg | 667.8 | 266.7 |
| Acetone, μg | 296.2 | 114.7 |
| Acrolein, μg | 68.7 | 40.4 |
| Total Carbonyls | 1042.5 | 431.6 |
| Carbonyl/tar ratio | 105.3 | 46.4 |
| NOx, μg | 198.2 | 78.8 |
| HCN, μg | 183.9 | 70.7 |
| $NH_3$, μg | 22.06 | 12.73 |

It will be seen from Example 2 that the high level of air dilution resulted in a CO level of 6.0 mg compared with 11.4 mg for the control cigarette. The pressure drop of the test cigarette (105 mm of water) was acceptable compared with the control cigarette (127 mm of water) and particulate matter (tar) levels were very comparable, 9.9 mg for the control and 9.3 mg for the test cigarette.

Figure 5:
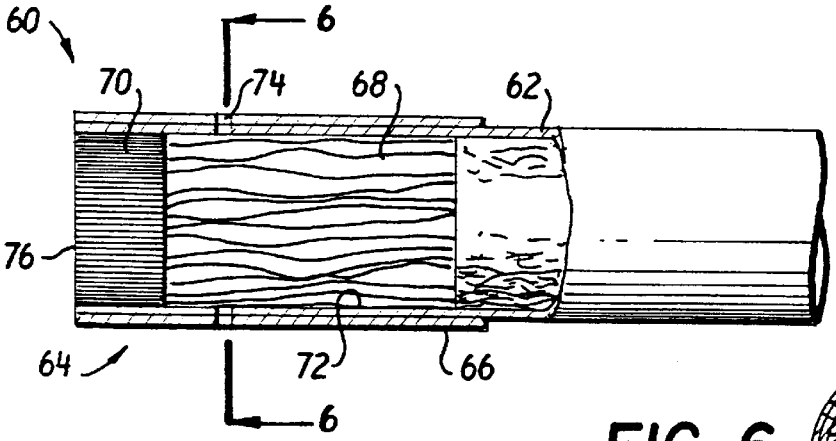
FIG. 5 is a fragmentary longitudinal cross-section of an alternative embodiment of a smoking article made according to the invention.
Figure 6:
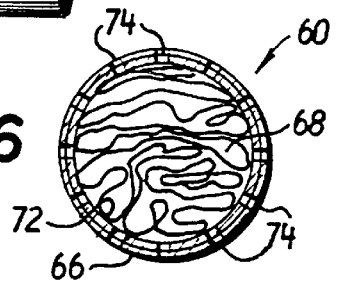
FIG. 6 is a transverse cross-section taken along line 6—6 of FIG. 5.

FIGS. 5 and 6 illustrate another embodiment of a dual segment filter made according to the invention. In this embodiment, the cigarette smoking article designated generally by reference numeral 60 comprises a tobacco rod 62 to which is attached a dual segment filter element 64 by means of tipping paper 66. Filter element 64 is formed with first and second filter segments 68, 70, respectively, which are combined with a conventional non-porous plug wrap 72.

The first filter segment 68 comprises a loosely gathered web of paper containing activated carbon in a range of about 10% to 50% by weight although greater or lesser amounts may be used. When gathered into a cylindrical form about 8 mm in diameter, a five inch wide web of carbon paper forms a segment with a number of longitudinal open channels which permit mainstream smoke to flow therethrough substantially unobstructed so as to have a very low pressure drop thereacross, e.g., less than about 5 mm of water. The second filter segment 70 is a cellulose acetate filter segment made of a tow material similar to that of filter segment 50 described above.

Air dilution is provided by circumferential holes formed by laser perforation in the first segment 68 to achieve substantial air dilution of about 30% to 65% or greater. Ventilating air drawn through holes 74 mixes with mainstream smoke in the open longitudinal channels of the gathered web of the first filter segment 68 and then passes through the second filter segment 70 to the mouth end 76 of the filter 64.

Instead of the gathered web of paper, the first filter segment 68 of a dual segment filter according to the invention may also be constructed with a fibrous material having a very low density and thus a very low pressure drop thereacross. Such filter segment 68 may be made, for example, from cellulose fibers, polypropylene fibers or any other low density fibrous material.

Cigarettes constructed according to the alternative embodiment of the dual segment filter of the invention shown in FIGS. 5 and 6 yielded significant reductions in CO and other gas phase components of the smoke to an even greater extent than the dual segment filter of FIGS. 3 and 4. The incorporation of activated carbon in the gathered web resulted in a greater reduction of gas phase components of mainstream smoke other than CO, e.g., carbonyls, than for filters without activated carbon. Such reduction in other gas phase components is especially significant when the amount of activated carbon in the gathered web is increased. The following examples demonstrate not only the effectiveness of the filter of the present invention in reducing CO without sacrificing flavor and pressure drop, but also the effectiveness of activated carbon in reducing other gas phase constituents of mainstream smoke, such as carbonyls.

EXAMPLE 3

The same type of tobacco rods and control cigarettes described in Examples 1 and 2 were used for this example. Test cigarettes according to the invention were made with a tobacco rod and filter comprising a first filter segment made of a five-inch wide web of carbon paper containing 17% by weight activated carbon and gathered into a cylindrical form with an axial length of 17 mm and combined, using a porous plug wrap, with a 10 mm mouth end segment made from the same cellulose acetate tow as in Example 2. The filter was laser perforated 13 mm from the mouth end to achieve an air dilution of about 55%. The control and test cigarettes were smoked under FTC conditions with the following results:

| Test Parameter | Control | Test |
|---|---|---|
| Filter | Conventional | Gathered Web, 17% carbon |
| Tob. Column Length, mm | 57 | 57 |
| Filter Length, mm | 27 | 27 |
| Filter segment length, mm | — | 17 + 10 |
| Air Dilution, % | 21.5 | 53.3 |
| Cigarette pressure drop, mm of water | 127 | 111 |
| FTC SMOKE DATA | | |
| Puffs/cigt. | 7.9 | 7.3 |
| WTPM, mg | 11.8 | 8.7 |
| Tar, mg | 9.9 | 7.2 |
| Nicotine, mg | 0.75 | 0.68 |
| CO, mg | 11.4 | 4.9 |
| CO/TAR Ratio | 1.15 | 0.68 |
| MS CARRBONYLS | | |
| Formaldehyde, μg | 9.8 | 6.9 |
| Acetaldehyde, μg | 667.8 | 246.1 |
| Acetone, μg | 296.2 | 91.3 |
| Acrolein; μg | 68.7 | 29.3 |
| Total Carbonyls | 1042.5 | 373.6 |
| OTHER MS DATA | | |
| NOx, μg | 198.2 | 62.3 |
| HCN, μg | 163.9 | 52.6 |
| $NH_3$, μg | 22.08 | 7.54 |

EXAMPLE 4

Control and test cigarettes were made as in Example 3 except that the gathered web was made with a paper containing about 50% by weight activated carbon. The cigarettes were smoked under FTC conditions and yielded the following results:

| Description | Control | Test |
|---|---|---|
| Filter | Conventional | Gathered Web, 50% carbon |
| Tob. Column Length, mm | 57 | 57 |
| Filter Length, mm | 27 | 27 |
| Filter segment length, mm | — | 17 + 10 |
| Air Dilution, % | 21.5 | 50.8 |
| Cigarette pressure drop, mm of water | 127 | 102 |
| FTC SMOKE DATA | | |
| Puffs/cigt. | 7.9 | 7.9 |
| WTPM, mg | 11.8 | 11.6 |
| Tar, mg | 9.9 | 9.6 |
| Nicotine, mg | 0.75 | 0.92 |
| CO, mg | 11.4 | 7.1 |
| CO/TAR Ratio | 1.15 | 0.74 |
| MS CARBONYLS | | |
| Formaldehyde, μg | 9.8 | 7.3 |
| Acetaldehyde, μg | 667.8 | 118.5 |
| Acetone, μg | 296.2 | 32.3 |
| Acrolein, μg | 68.7 | 15.5 |
| Total Carbonyls | 1042.5 | 173.6 |
| OTHER MS DATA | | |
| NOx, μg | 198.2 | 42.3 |
| HCN, μg | 163.9 | 29.1 |
| $NH_3$, μg | 22.06 | 12.59 |

It will be seen from Examples 3 and 4 that the high level of air dilution resulted in significant reduction of CO with acceptable pressure drops and particulate matter (tar) levels. Increasing the amount of carbon in the gathered web resulted in a significant reduction of other gas phase constituents, such as carbonyls and nitrogen-containing compounds.

In addition, at high air dilution levels, the rate of flow of mainstream smoke through the gathered web segment is reduced thereby increasing the residence time of the smoke in the gathered web segment. This increased residence time improves the removal efficiency of the carbon in the gathered web segment.

The present invention has also been tested with similar results using other tobacco rod forms, such as the low side stream tobacco rods disclosed in U.S. Pat. No. 5,220,930, issued Jun. 22, 1993, of Gentry et al., assigned to the assignee of this invention.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. A smoking article comprising a rod of smokable material and a filter having a predetermined length and two ends, one end of which is attached to the rod of smokable material and the other end of which comprises the mouth end of the filter, said filter comprising a unitary filter element and having first and second filter portions, said filter element comprising steam-bonded cellulose acetate, the first filter portion being disposed adjacent the rod of smokable material and having no substantial longitudinal pressure drop, the first filter portion including a central cavity open toward said rod and closed toward the second filter portion, the closed end of said cavity having a tapered wall terminating in a vertex at said second filter portion, the second filter portion being disposed downstream of the first filter portion adjacent the mouth end of the filter, the second filter portion having an annular region surrounding a central region of lower density than said annular region, and air dilution means disposed in said first filter portion for admitting at least 30% ventilating air into the first portion of the filter, substantially all the pressure drop across said filter being effected in said second filter portion downstream of said air dilution means.

2. The smoking article of claim 1, wherein a portion of said cavity has a cylindrical shape with a diameter of about 4 mm, the length of said cavity from the open end to the vertex thereof being about 15 mm to about 20 mm and said second filter portion having a length of about 7 mm to about 12 mm.

3. The smoking article of claim 2, wherein said air dilution means comprise a plurality of circumferential holes in said first filter portion disposed about 13 mm from the mouth end of the filter.

4. The smoking article of claim 3, wherein said holes are laser perforations.

5. The smoking article of claim 1, wherein the air dilution means comprises a plurality of circumferential holes in said first filter portion, said holes admitting more than 50% ventilating air into the first filter portion, the pressure drop of said smoking article being greater than 100 mm of water.

6. The smoking article of claim 1, wherein said tapered wall is conically tapered.

7. The smoking article of claim 1, wherein said air dilution is in the range of 50% to 60%.

* * * * *